US008943852B2

(12) United States Patent
Lee et al.

(10) Patent No.: US 8,943,852 B2
(45) Date of Patent: Feb. 3, 2015

(54) REFRIGERATOR INCLUDING ICE MAKING DEVICE

(75) Inventors: Dong Hoon Lee, Seoul (KR); Tae Hee Lee, Seoul (KR); Dong Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1022 days.

(21) Appl. No.: 12/758,057

(22) Filed: Apr. 12, 2010

(65) Prior Publication Data

US 2010/0313594 A1 Dec. 16, 2010

(30) Foreign Application Priority Data

Jun. 11, 2009 (KR) ..... 10-2009-0051895

(51) Int. Cl.
*F25D 3/02* (2006.01)
*F25D 17/06* (2006.01)
*F25C 1/00* (2006.01)

(52) U.S. Cl.
CPC ..... *F25D 17/062* (2013.01); *F25C 1/00* (2013.01); *F25C 2400/10* (2013.01); *F25D 2317/062* (2013.01); *F25D 2317/063* (2013.01); *F25D 2317/0665* (2013.01); *F25D 2500/02* (2013.01)
USPC ..... 62/420; 62/425

(58) Field of Classification Search
USPC ..... 62/420, 425, 406–407
See application file for complete search history.

(56) References Cited

U.S. PATENT DOCUMENTS 6,438,988 B1 * 8/2002 Paskey ..... 62/353
6,725,685 B2 4/2004 Kang
6,732,537 B1 * 5/2004 Anell et al. ..... 62/71
7,188,479 B2 * 3/2007 Anselmino et al. ..... 62/66
7,458,230 B2 * 12/2008 Lee et al. ..... 62/353
7,596,964 B2 10/2009 Lim et al.
2005/0061018 A1 3/2005 Kim et al.
2006/0086130 A1 4/2006 Anselmino
2006/0266055 A1 11/2006 Anderson et al.
2007/0084229 A1 * 4/2007 Han et al. ..... 62/340
2007/0163286 A1 7/2007 Lim et al.
2008/0034780 A1 * 2/2008 Lim et al. ..... 62/353
2008/0307823 A1 * 12/2008 Lee et al. ..... 62/441

(Continued)

FOREIGN PATENT DOCUMENTS

AU 2010 259495 B2 9/2013
CN 1598452 A 3/2005

(Continued)

OTHER PUBLICATIONS

PCT International Search Report and Written Opinion for Application No. PCT/KR2010/002300, dated Oct. 10, 2011, 14 pages.

(Continued)

*Primary Examiner* — Cheryl J Tyler
*Assistant Examiner* — David Teitelbaum
(74) *Attorney, Agent, or Firm* — Fish & Richardson P.C.

(57) ABSTRACT

A refrigerator, which includes an ice making compartment, an ice making device arranged in the ice making compartment, and an ice making tray provided at the ice making device and configured to receive and retain water to be frozen to make ice. The refrigerator also includes a cold air inlet provided at the ice making compartment and configured to allow cold air to be introduced into the cold air compartment, and a cold air guide configured to guide cold air from the cold air inlet toward the ice making tray.

20 Claims, 16 Drawing Sheets

(56) References Cited

U.S. PATENT DOCUMENTS

| | | | | |
|---|---|---|---|---|
| 2009/0064703 | A1* | 3/2009 | Kim et al. | 62/344 |
| 2010/0218544 | A1* | 9/2010 | Fotiadis et al. | 62/407 |

FOREIGN PATENT DOCUMENTS

| | | | |
|---|---|---|---|
| EP | 1 517 103 | A2 | 3/2005 |
| EP | 1813896 | A2 | 8/2007 |
| EP | 1821051 | A1 | 8/2007 |
| EP | 1 517 103 | B1 | 11/2011 |
| JP | 54-024153 | A | 2/1979 |
| JP | 4-263771 | A | 9/1992 |
| JP | 6-011228 | A | 1/1994 |
| JP | 54-024153 | U | 2/1997 |
| KR | 10-2005-0094674 | A | 9/2005 |
| KR | 10-2006-0053132 | A | 5/2006 |
| KR | 10-2007-0010547 | A | 1/2007 |
| RU | 2330221 | C2 | 7/2008 |
| WO | WO 2010/122752 | | 10/2010 |

OTHER PUBLICATIONS

Russian Decision on Grant dated Feb. 26, 2013 for Application No. 2011150477, with English Translation, 12 pages.

Mexican Office Action dated Feb. 11, 2014 for Application No. MX/A/2011/011664, with English Translation, 8 pages.

Chinese Office Action dated Sep. 18, 2013 for Application No. 201080021796.9, with English Translation, 16 pages.

* cited by examiner

REFRIGERATOR INCLUDING ICE MAKING DEVICE

This application claims the benefit of Korean Patent Application No. 10-2009-0051895, filed on Jun. 11, 2009, which is hereby incorporated by reference as if fully set forth herein.

FIELD

The present disclosure relates to a refrigerator including an ice making device.

BACKGROUND

A refrigerator is a home appliance for storing food in a refrigerated or frozen state using a refrigerant cycle. Such a refrigerator includes a body having a storage compartment such as a freezing compartment or a refrigerating compartment, and a door mounted to the body, to open or close the storage compartment.

An ice making compartment, in which ice is made and stored, is provided at the storage compartment or door. An ice making device, which includes an ice making tray, is arranged in the ice making compartment. A water supplying device is also arranged in the ice making compartment, to supply water to the ice making tray.

In an ice making operation carried out in the conventional refrigerator, water is supplied to the ice making tray, and is then frozen by cold air introduced into the ice making compartment, thereby forming ice having a particular shape.

After the ice making operation is completed, the ice is separated from the ice making tray as the ice making tray rotates, and is then stored in an ice storage box arranged near the ice making tray. The separation of ice may be achieved using a separate ice separating device.

SUMMARY

In one aspect, a refrigerator includes an ice making compartment, an ice making device arranged in the ice making compartment, and an ice making tray provided at the ice making device and configured to receive and retain liquid be frozen into ice. The refrigerator also includes a cold air inlet provided at the ice making compartment and configured to allow cold air to be introduced into the cold air compartment. The refrigerator further includes a cold air guide configured to guide cold air entering the ice making compartment through the cold air inlet toward the ice making tray.

Implementations may include one or more of the following features. For example, the cold air inlet may be arranged at a side wall of the ice making compartment and the cold air guide may be mounted to an inner surface of the side wall of the ice making compartment while being arranged over the ice making tray.

In some implementations, the cold air guide may include a hollow guide body, an inlet section provided at the guide body such that the inlet section communicates with the cold air inlet, and an outlet section provided at the guide body and configured to discharge cold air toward the ice making tray. In these implementations, the cold air guide may include a guide rib arranged in the guide body and configured to guide cold air flowing from the inlet section toward the outlet section. The guide rib may be inclined with respect to a surface of the ice making tray and configured to change a flow direction of a portion of cold air flowing from the inlet section toward the outlet section.

In some examples, the guide rib may include an upper guide rib provided at an inner surface of a top of the guide body and a lower guide rib provided at an inner surface of a bottom of the guide body. In these examples, the upper guide rib may be arranged in a zone where cold air flowing in the guide body has a maximum flow velocity, and may have an inclined portion having a predetermined inclination angle to guide cold air flow through the cold air guide. The upper guide rib may include a plurality of upper guide ribs arranged at the inner surface of the top of the guide body while being spaced apart from one another by a predetermined spacing.

In addition, the lower guide rib may include a plurality of lower guide ribs arranged at the outlet section while being inclined with respect to a surface of the ice making tray at different inclination angles. The lower guide rib may be configured to redirect cold air flow to a direction opposite to a flow direction of cold air flowing from the inlet section toward the outlet section.

In some implementations, the cold air inlet may be arranged at a top wall of the ice making compartment and the cold air guide may be mounted to an inner surface of the top wall of the ice making compartment. In these implementations, the cold air guide may be arranged to extend over an entire top surface of the ice making tray and may be configured to uniformly distribute cold air passing through the cold air inlet to the entire top surface of the ice making tray.

In some examples, the cold air guide may include a hollow guide body, an inlet section provided at a top of the guide body such that the inlet section communicates with the cold air inlet, and an outlet section provided at a bottom of the guide body such that the outlet section directs cold air toward the ice making tray. In these examples, the cold air guide may include a guide rib arranged in the guide body and configured to uniformly distribute cold air flowing from the inlet section toward the outlet section over the entire top surface of the ice making tray. The guide rib may include a plurality of guide ribs arranged at the outlet section while being inclined toward a top surface of the ice making tray at different inclination angles.

Further, the guide body may have an extension extending downwardly from a side wall of the guide body. The extension may be configured to reduce lateral leakage of cold air from the guide body after entering through the cold air inlet. The cold air guide may include a seal member interposed between the inlet section and the cold air inlet. The inlet section may extend toward the cold air inlet such that an extension of the inlet section is arranged in the cold air inlet.

In some implementations, the ice making compartment may be arranged in a refrigerator body or at a refrigerator door and the cold air guide may be connected to the cold air inlet, and may be arranged beneath the ice making tray such that the cold air guide directs cold air over a bottom portion of the ice making tray. In these implementations, the cold air guide may include a bottom wall arranged to be spaced apart from a bottom of the ice making tray and a side wall extending upwardly from a side of the bottom wall while being spaced apart from a side of the ice making tray.

The details of one or more implementations are set forth in the accompanying drawings and the description, below. Other potential features and advantages of the disclosure will be apparent from the description and drawings, and from the claims.

DETAILED DESCRIPTION

Figure 1:
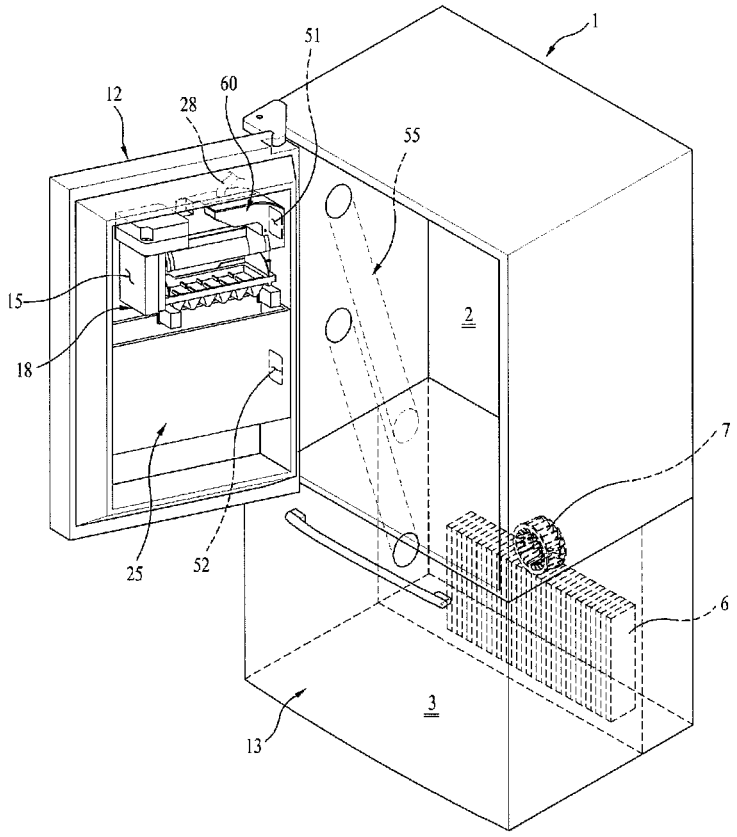
FIG. 1 is a perspective view of a refrigerator.

FIG. 1 illustrates an example refrigerator. Referring to FIG. 1, a refrigerator according to the present invention is illustrated. As shown in FIG. 1, the refrigerator includes a body 1 having a refrigerating compartment 2 and a freezing compartment 3, a refrigerating compartment door 12 pivotally mounted to the body 1, to open or close the refrigerating compartment 2, and a freezing compartment door 13 slidably mounted to the body 1, to open or close the freezing compartment 3.

In the illustrated example, the refrigerating compartment 2 is arranged at an upper portion of the body 1, and the freezing compartment 3 is arranged at a lower portion of the body 1. However, the disclosure is not limited to the illustrated example. For instance, the freezing compartment 3 may be arranged at the upper portion of the body 1. A side-by-side type structure, in which the refrigerating compartment 2 and freezing compartment 3 are horizontally arranged in parallel, also may be used.

An ice making compartment 15 is provided at a back surface of the refrigerating compartment door 12. Installed in the ice making compartment 15 are an ice making device 18 to make ice, and an ice storage box 25 to store ice separated from the ice making device 18.

The ice making device 18 includes an ice making tray 19 to receive water therein, and a driving unit 20 connected to the ice making tray 19, to rotate the ice making tray 19, or to drive an ice separating heater.

A water supply hose 28 is arranged over the ice making tray 19, to supply water to the ice making tray 19.

A cold air inlet 51 is provided at one side wall of the ice making compartment 15, to introduce cold air into the ice making compartment 15. A cold air outlet 52 is also provided at the side wall of the ice making compartment 15, to discharge the cold air from the ice making compartment 15.

The cold air inlet 51 and cold air outlet 52 are connected to a cold air guide duct 55 installed in a side wall of the body 1.

The cold air guide duct 55 functions not only to feed the cold air from the freezing compartment 3 arranged at the lower portion of the body 1 to the ice making compartment 15, but also to again feed the cold air from the ice making compartment 15 to the freezing compartment 3.

In detail, when cold air is generated around an evaporator 6 arranged at the rear of the freezing compartment 3, a major part of the cold air is introduced into the freezing compartment 3 in accordance with operation of the cold air fan 7. The remaining part of the cold air is fed to the ice making compartment 15 by being guided by the cold air guide duct 55.

When the user closes the refrigerating compartment door 12, the cold air inlet 51 and cold air outlet 52 are connected to the cold air guide duct 55 in accordance with the above-described configuration.

A cold air guide 60 is arranged in the ice making compartment 15, to concentrate the cold air discharged through the cold air inlet 51 into the ice making device 18.

The cold air guide 60 is installed above the ice making device 18, in particular, a portion of the ice making tray 19, such that the cold air guide 60 is spaced apart from the ice making tray 19. In particular, the cold air guide is mounted to an inner surface of the side wall of the ice making compartment 15 where the cold air inlet 51 is defined.

In this case, the cold air guide 60 may be installed at one side of the water supply hose 28.

Figure 2:
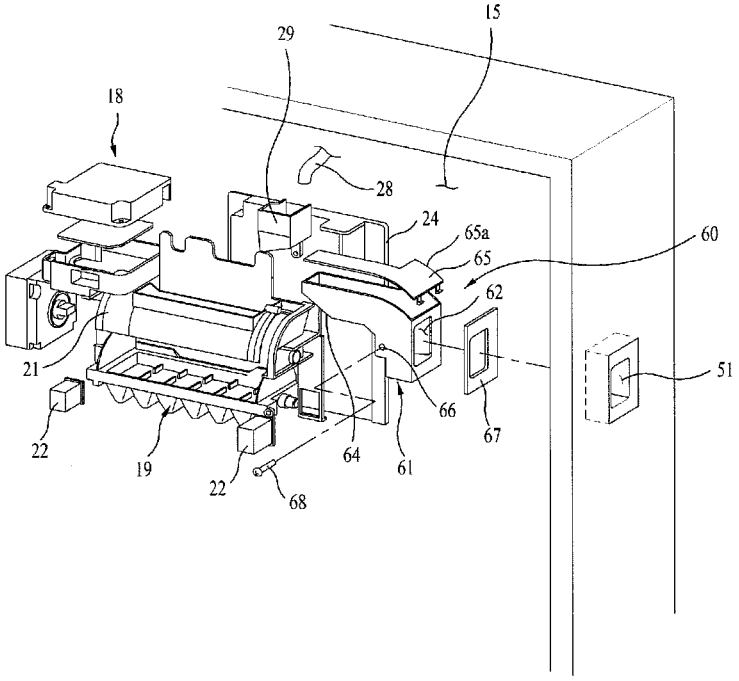
FIG. 2 is an exploded perspective view of an ice making device included in the refrigerator.

FIG. 2 illustrates an example configuration of the ice making device 18. As shown in FIG. 2, the ice making tray 19 is included in the ice making device 18. The interior of the ice making tray 19 is divided into a plurality of spaces each having a certain size. The ice making device 18 also includes a water spattering preventing plate 21 arranged at one side of the ice making tray 19. The driving unit 20, which is arranged at one side of the ice making tray 19, is also included in the ice making device 18.

An ice fullness sensor 22 is arranged beneath the ice making tray 19, to sense how full the ice storage box 25 is with ice (FIG. 1). In the illustrated case, the ice fullness sensor 22 is constituted by an infrared sensor. Of course, a lever type sensor may be used for the ice fullness sensor 22.

A fixing bracket 24 is arranged at the rear of the ice making tray 19, to fix the ice making device 18 to the ice making compartment 15. A water supply guide 29 is provided at the fixing bracket 24, to guide water supplied to the ice making tray 19.

The water supply guide 29 functions to receive water discharged from the water supply hose 28, and to guide the received water to the ice making tray 19.

The cold air guide has a duct shape. The cold air guide 60 includes a hollow guide body 61, an inlet section 62 provided at the guide body 61 such that the inlet section 62 communicates with the cold air inlet 51, an outlet section 64 arranged opposite to the inlet section 62, and a cover member 65 separably mounted to the guide body 61, to form a top of the guide body 61.

The cover member 65 may have a curved portion **65*a* at a position near the inlet section 62. The curved portion 65*a* of the cover member 65 guides cold air passing through the inlet section 62 to flow gently when the cold air reaches the cover member 65**.

The cover member 65 may be positioned integrally with the guide body 61.

A seal member 67 may be interposed between the cold air guide 60 and the cold air inlet 51, in order to reduce (e.g., prevent) leakage of cold air.

Meanwhile, coupling holes 66 are provided at side walls of the cold air guide 60. Coupling members 68 such as screws are inserted into the coupling holes 66, to be threadedly coupled to the fixing bracket 24. Thus, the cold air guide 60 is firmly coupled to the fixing bracket 24.

Figure 3:
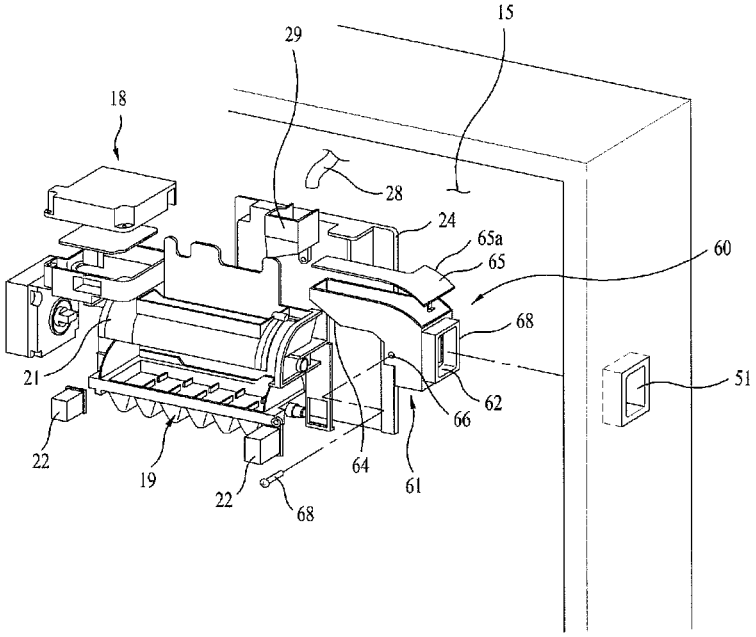
FIG. 3 is an exploded perspective view of an ice making device included in a refrigerator.

FIG. 3 illustrates another example of the cold air guide 60. In this example, the inlet section 62 of the cold air guide 60 has a protrusion 68 protruded toward the cold air inlet 51 by a predetermined length such that it extends into the cold air inlet 51.

The configurations of FIG. 3, except for the protrusion structure, are identical to those of FIG. 2, so no detailed description thereof will be given.

Figure 4:
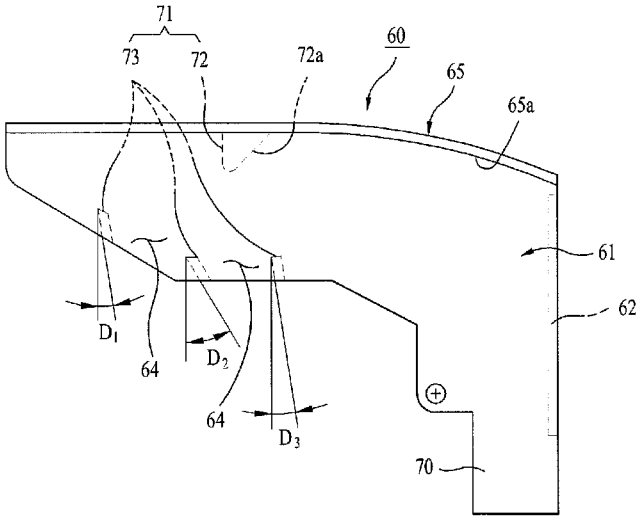
FIG. 4 is a side view of a cold air guide.
Figure 5:
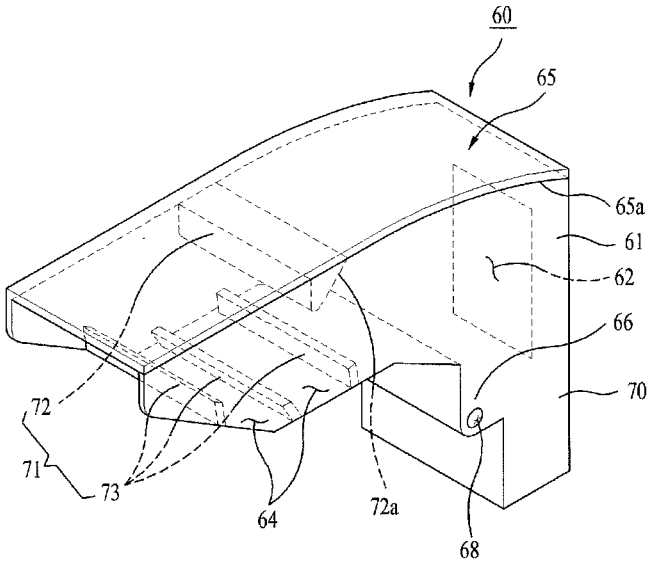
FIG. 5 is a perspective view of a cold air guide.

FIGS. 4 and 5 illustrate an example of the cold air guide 60. As shown in FIGS. 4 and 5, the inlet section 62 is provided at one end of the guide body 61, and the outlet section 64 is provided at the other end of the guide body 61 while extending from the other end of the guide body 61 along a bottom portion of the guide body 61 by a predetermined length.

A downward extension 70 is defined at one end of the guide body 61, namely, a portion of the guide body 61 near the cold air inlet 51.

The extension 70 reduces (e.g., prevents) cold air discharged from the cold air inlet 51 into the inlet section 62 from leaking laterally just after passing through the inlet section 62. The extension 70 also guides the cold air to the outlet section 64.

That is, the extension 70 functions to upwardly guide cold air toward the outlet section 64 because the outlet section 64 of the cold air guide 60 is arranged at a higher position than the cold air inlet 51.

As described above, the curved portion 65*a* is provided at a portion of the cover member 65 near the inlet section 62. Accordingly, cold air passing through the inlet section 62 can flow toward the outlet section 64 along the curved portion 65*a* of the cover member 65 without forming a vortex flow when the cold air reaches the cover member 65.

A guide rib 71 is provided at the guide body 61, to guide a flow of cold air flowing from the inlet section 62 toward the outlet section 64.

The guide rib 71 has an inclined surface to guide a part of the cold air flow flowing from the inlet section 62 toward the outlet section 64.

The guide rib 71 is divided into an upper guide rib 72 and a lower guide rib 73 in accordance with the position thereof.

The upper guide rib 71 is provided at an inner surface of the top portion of the guide body 61. The lower guide rib 73 is provided at an inner surface of the bottom portion of the guide body 61 such that it extends across the outlet member 64.

The upper guide rib 72 has an inclined surface 72*a* having an inclination wherein the inclined surface 72*a* is directed to the upper surface of the ice making tray 19 while facing the inlet section 62.

The upper guide rib 72 may be arranged in an internal portion of the guide body 61 corresponding to a maximal air flow velocity zone, substantially in the vicinity of a central portion of the guide body 61. The inclination angle of the inclined surface 72*a* may be about 45°.

When the upper guide rib 72 is arranged in the maximal air flow velocity zone, it may be possible to obtain a great air flow direction change effect. In this case, air can flow farther in the changed flow direction.

The lower guide rib 73 may be provided in plural and may be inclinedly arranged. In this case, the plural lower guide ribs 73 may have different inclination angles, for example, D1, D2, and D3 in the illustrated case.

The reason why the lower guide ribs 73 have different inclination angles D1, D2, and D3 is that it is necessary to uniformly distribute cold air in a region over the ice making tray 19.

Meanwhile, most of the lower guide ribs 73 are arranged to be directed to a portion of the ice making tray 19 arranged at the side of the inlet section 62. Most cold air passing through the inlet section 62 will naturally fall onto the ice making tray 19 arranged beneath the outlet section 64 after passing through the outlet section 64, by virtue of inertia.

Under such a flow mechanism, cold air is concentrated onto a portion of the ice making tray 19 arranged near the outlet section 64. As a result, the portion of the ice making tray 19 exhibits a temperature difference from a portion of the ice making tray 19 arranged near the inlet section 62, so that completion of ice making may occur, starting from the portion of the ice making tray 19 arranged near the outlet section 64. That is, ice making is carried out in a biased fashion due to biased supply of cold air.

In order to reduce (e.g., prevent) such biased supply of cold air, accordingly, cold air falling after emerging from the outlet section 64 is directed to the portion of the ice making tray 19 arranged near the inlet section 62.

Figure 6:
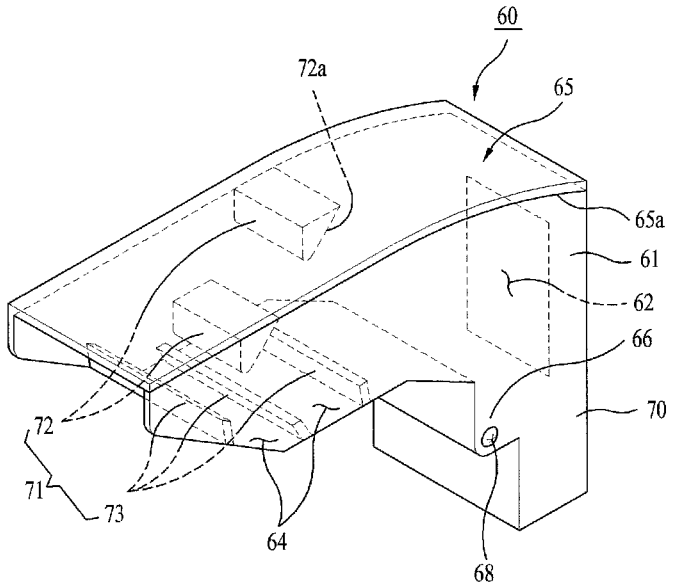
FIG. 6 is a perspective view of another cold air guide.

FIG. 6 illustrates another example of the cold air guide 60. The example shown in FIG. 6 is different from the example shown in FIG. 5 in that a plurality of upper guide ribs 72 are provided, in place of the single upper guide rib 72, and are spaced apart from one another.

Of course, the inclined surface 72*a* of each upper guide rib 72 is directed to the inlet section 62 such that it faces the inlet section 62, similarly to the example of FIG. 5.

A part of the plural upper guide ribs 72 are arranged adjacent to one side wall of the guide body 61, whereas the remaining part of the plural upper guide ribs 72 are arranged adjacent to the other side wall of the guide body 61, in order to cause the flow of cold air to be changed in direction at several positions, and thus to uniformly distribute cold air over the entirety of the ice making tray 19.

Figure 7:
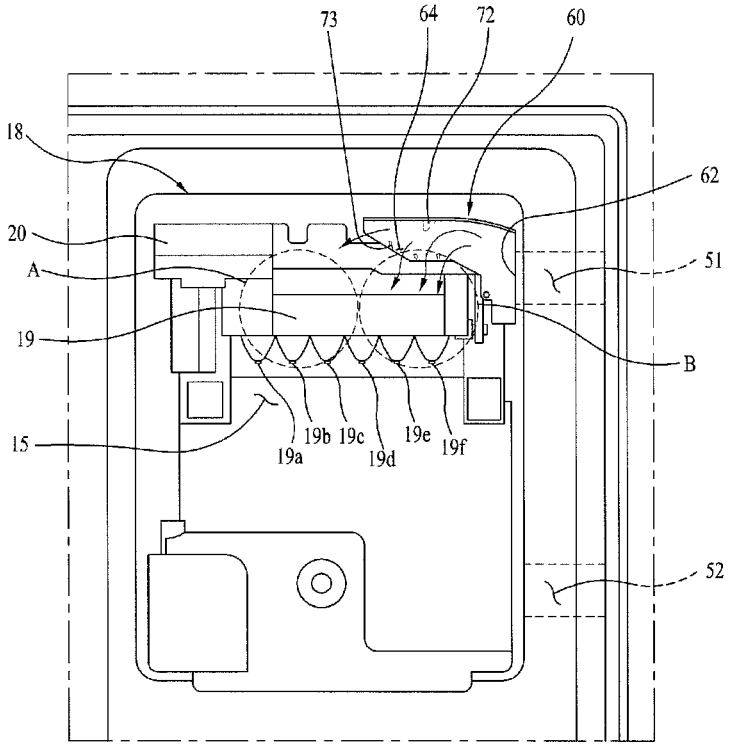
FIG. 7 is a view illustrating a flow of cold air.

Referring to the flow of cold air introduced into the cold air guide 60, as shown in FIG. 7, cold air passing through the inlet section 62 flows toward the outlet section 64. At this time, the cold air initially reaches the upper guide rib 72, so that it flows inclinedly in a downward direction.

Under this condition, the cold air then falls toward the ice making tray 19 while passing through the outlet section 64. At this time, the cold air is moved to the ice making tray 19 as it is guided by the lower guide ribs 73.

In particular, the lower guide ribs 73 guide the cold air in a concentrated manner to the portion of the ice making tray 19, to which cold air flow could not be moved if the lower guide ribs 19 were not present, that is, the portion of the ice making tray 19 arranged near the inlet section 62. As a result, the cold air is uniformly distributed over the entirety of the ice making tray 19.

If the cold air guide 60 is not present, cold air introduced into the ice making compartment 15 through the cold air inlet 51 may be dispersed to the ice making tray 19 and a region beneath the ice making tray 19.

Under this condition, cold air passing through the cold air inlet 51 mainly flows to a portion of the ice making tray 19 (portion A) arranged adjacent to the driving unit 20, rather than to the portion of the ice making tray 19 (portion B) arranged adjacent to the cold air inlet 51. As a result, the distribution of cold air is non-uniform.

However, such non-uniform cold air distribution may be eliminated by the cold air guide 60.

Meanwhile, the cold air guide 60 does not extend over the entire length of the ice making tray 19, that is, the cold air guide 60 has a length corresponding to about half of the length of the ice making tray 19, and is arranged adjacent to the cold air inlet 51.

If the cold air guide 60 has a length substantially equal to the length of the ice making tray 19, and is arranged over the entirety of the ice making tray 19, cold air moved to the top of the ice making tray 19, in particular, a portion of the ice making tray 19 arranged near the driving unit 20, after passing through the cold air inlet 51, may continuously stay at this tray portion.

To this end, the length of the cold air guide 60 is shorter than that of the ice making tray 19, in order to continuously supply new cold air to the ice making tray 19 while rapidly discharging the cold air remaining around the ice making tray 19 using the new cold air.

In FIG. 7, a leftmost part of the portion A of the ice making tray 19 is designated by reference numeral "19*a*", and a rightmost part of the portion B of the ice making tray 19 is designated by reference numeral "19*f*". Parts of the ice making tray 19 between the tray part 19*a* and the tray part 19*f* are designated as tray parts 19*b*, 19*c*, 19*d*, and 19*e*.

Hereinafter, ice making rates in the case of using the cold air guide 60 and in the case of not using the cold air guide will be described.

Figure 8:
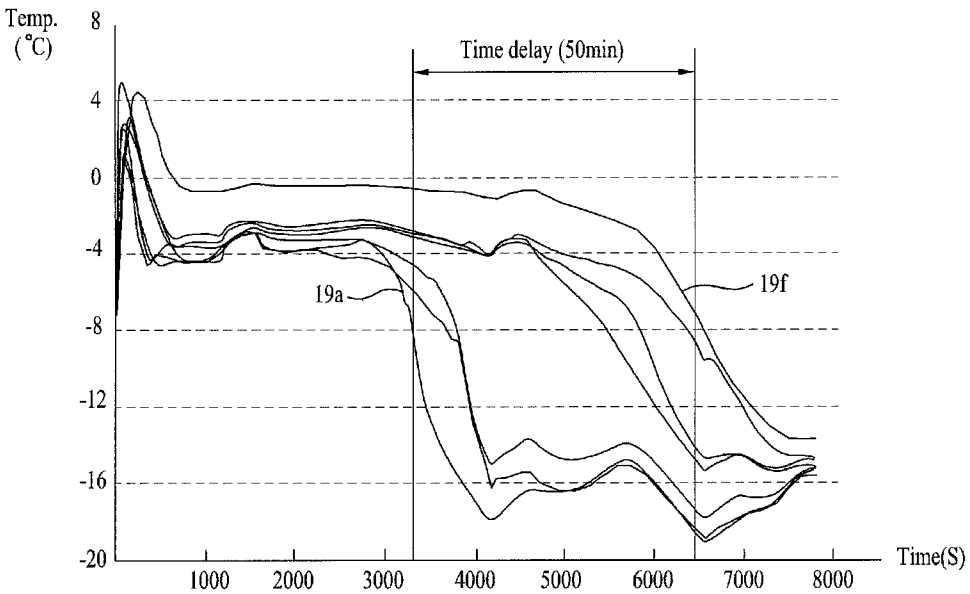
FIG. 8 is a graph depicting an ice making completion time in the case in which a cold air guide is not used.

FIG. 8 is a graph depicting a variation in the temperature of water or ice stored in the ice making tray with passage of time. FIG. 8 shows an ice making completion time in the case in which the cold air guide 60 is not used.

When it is assumed that the temperature, at which ice making is completed, is −8° C., the difference between the time taken to complete ice making at the tray part 19*a* and the time taken to complete ice making at the tray part 19*f*, namely, a time delay, may be about 50 minutes.

Such a time delay represents the fact that the supply amount of cold air is increased toward the tray part 19*a*, while being decreased toward the tray part 19*f*, so that the distribution of the supplied cold air is non-uniform.

Figure 9:
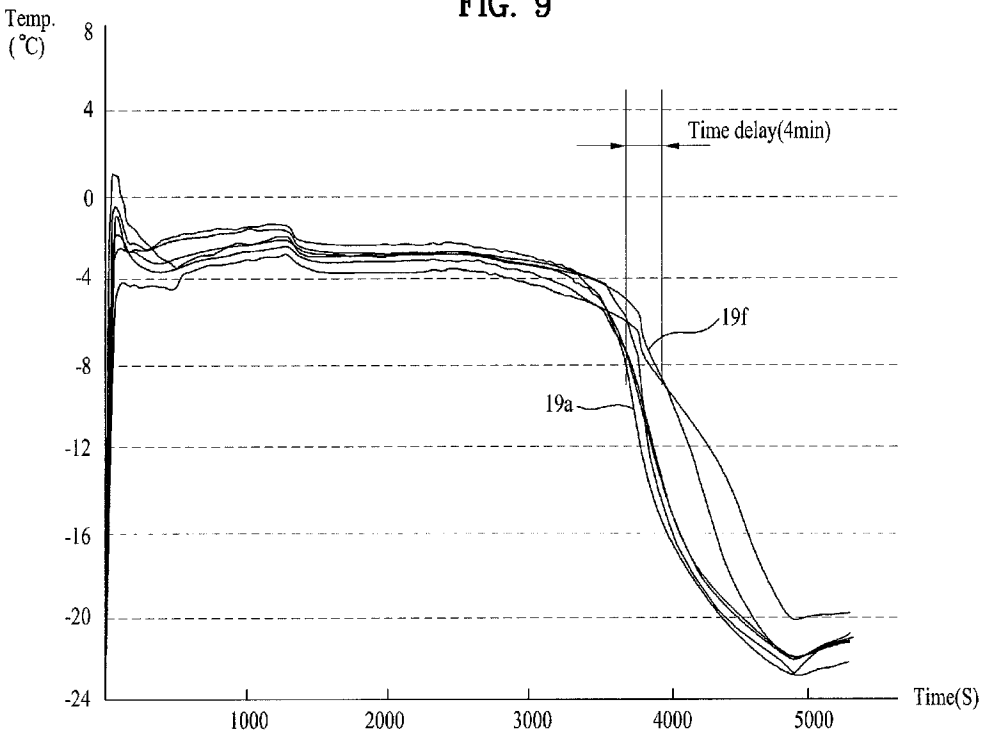
FIG. 9 is a graph depicting an ice making completion time in the case in which the cold air guide is used.

FIG. 9 illustrates ice making completion time when the guide 60 is used. As shown, in the case in which the cold air guide 60 is used, the difference between the time taken to complete ice making at the tray part 19*a* and the time taken to complete ice making at the tray part 19*f*, namely, the time delay, may be reduced to 4 minutes.

The determination of whether ice making is entirely completed is based on whether ice making is completed at the tray part where ice making is completed latest. When the cold air guide 60 is used as described above, it is possible to complete ice making more rapidly.

Figure 10:
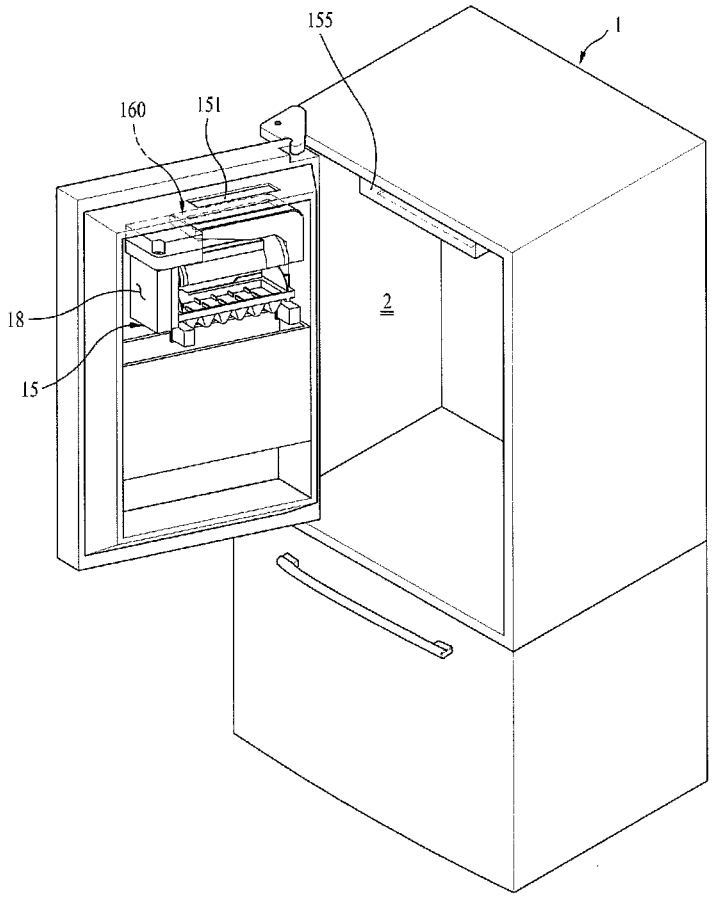
FIG. 10 is a perspective view of a refrigerator.

FIG. 10 illustrates an example in which the cold air inlet is not formed at the side wall of the ice making compartment 15, but is formed at the top wall of the ice making compartment 15. In FIG. 10, the cold air inlet is designated by reference numeral "151".

In this configuration, the cold air guide duct 155 is arranged at the top of the refrigerating compartment 2. The ice making device 18 and a cold air guide 160, which guides cold air to the ice making device 18, are mounted to the ice making compartment 15 beneath the cold air inlet 151.

The other components are similar to the components described above with respect to FIG. 1. Accordingly, description thereof has not been repeated.

In the case illustrated in FIG. 10, the refrigerating compartment 2 is arranged at the upper portion of the body 1, and the freezing compartment 3 is arranged at the lower portion of the body 1. However, the disclosure is not limited to the illustrated case. For example, a side-by-side type structure, in which the refrigerating compartment 2 and freezing compartment 3 are horizontally arranged in parallel, may be used.

Figure 11:
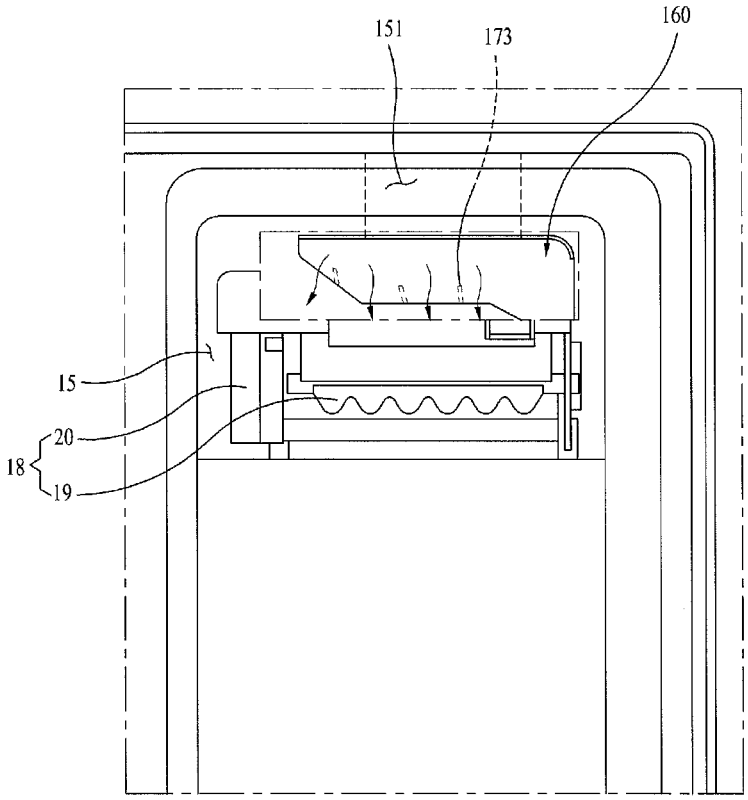
FIG. 11 is a view illustrating an ice making compartment in the refrigerator.

As shown in FIG. 11, the cold air guide 160 is arranged over the ice making device 18. In particular, the cold air guide 160 may have a length corresponding to the length of the ice making tray 19 of the ice making device 18.

This allows uniform distribution of cold air passing through the cold air inlet 151 over the entirety of the ice making compartment 15, because the cold air inlet 151 is provided at the top of the ice making compartment 15.

Figure 12:
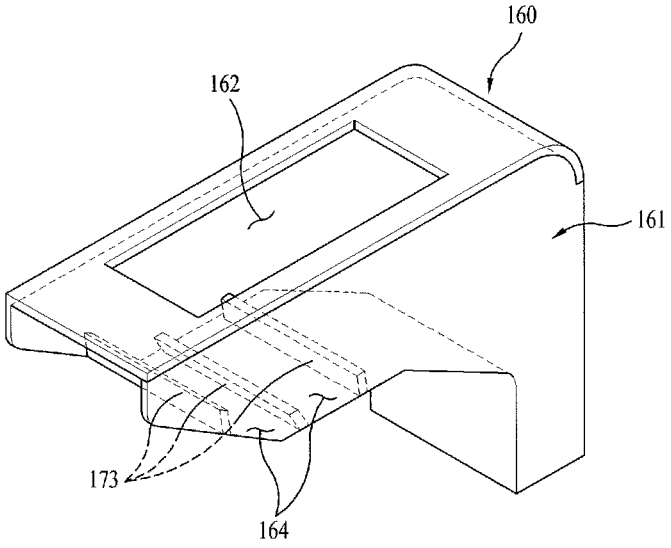
FIG. 12 is a perspective view of a cold air guide.
Figure 13:
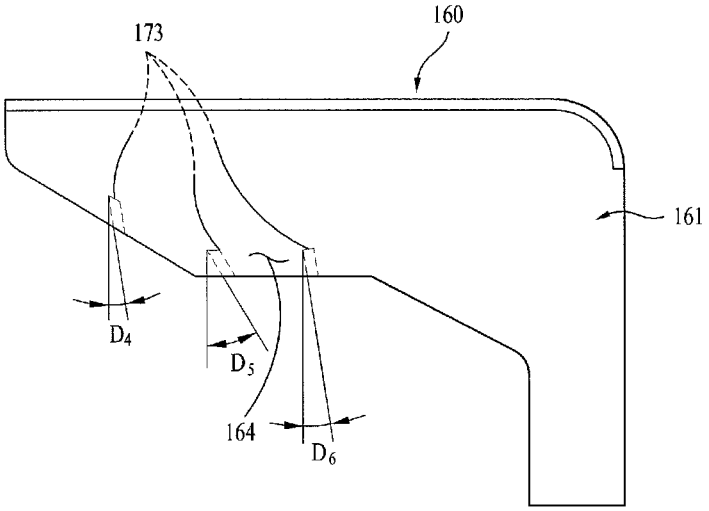
FIG. 13 is a cross-sectional view of the cold air guide.

As shown in FIGS. 12 and 13, the cold air guide 160 includes a guide body 161, an inlet section 162 provided at a top portion of the guide body 161, and an outlet section 164 arranged beneath the inlet section 162.

Lower guide ribs 173 are arranged at the outlet section 164 while being spaced apart from one another by a predetermined space, to guide cold air to the ice making tray 19. The lower guide ribs 173 extend inclinedly while having different inclination angles D4, D5, and D6, respectively.

As shown in FIG. 11, cold air, which passes through the cold air inlet 151 arranged at the top of the ice making compartment 15, enters the cold air guide 160, and then falls onto the top of the ice making tray 19 after passing through the outlet section 164.

At this time, the cold air falls in various directions by being guided by the lower guide ribs 173. As a result, the cold air is uniformly distributed over the entirety of the ice making tray 19. Accordingly, uniform ice making over the entirety of the ice making tray 19 is carried out.

In each of the ice making devices shown in FIGS. 1 to 12, the ice making tray of the ice making device 18 is configured to separate ice therefrom when it is rotated by the driving unit 20. For this function, the ice making tray 19 may be formed of a molded plastic product.

Figure 14:
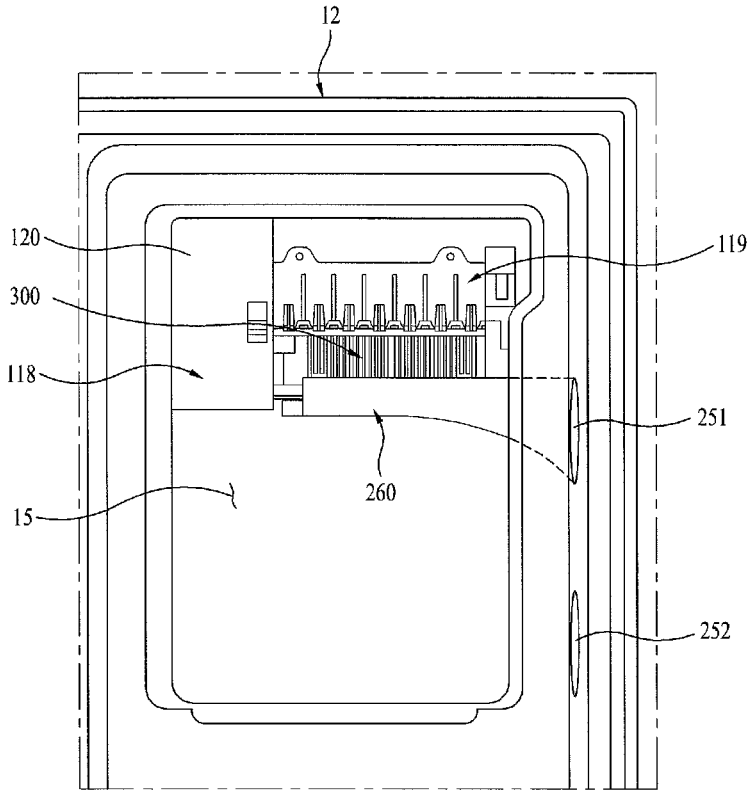
FIG. 14 is a view illustrating an ice making compartment in a refrigerator.

The refrigerator may have a configuration in which a cold air guide is arranged beneath an ice making device, as shown in FIG. 14.

In this case, the refrigerator includes the ice making compartment 15 defined by walls at the back surface of the refrigerating compartment door 12, and an ice making device 118 arranged in the ice making compartment 15. The ice making device 118 includes an ice making tray 119, and a driving unit 120 to drive an ice separating heater provided at the ice making tray 119.

A cold air guide 260 may be arranged beneath the ice making tray 119 such that it surrounds a bottom portion of the ice making tray 119.

A cold air inlet 251 is provided at one side wall of the ice making compartment 15, to introduce cold air into the ice making compartment 15. A cold air outlet 252 is also provided at the side wall of the ice making compartment 15, to outwardly discharge the cold air from the ice making compartment 15.

The cold air guide 260 is arranged at the side of the cold air inlet 251, to guide the cold air discharged through the cold air inlet 251 to be concentrated onto the bottom of the ice making tray 119.

The ice making tray 119 is made of a metal material, so that it exhibits enhanced thermal conductivity. Accordingly, when cold air is concentrated onto the bottom of the ice making tray 119 by the cold air guide 260, ice making in the ice making tray 119 can be rapidly carried out by a sub-zero temperature conducted by the ice making tray 119 itself.

In order to enhance the conductivity, cooling fins 300 may be positioned on an outer surface of the ice making tray 119.

Figure 15:
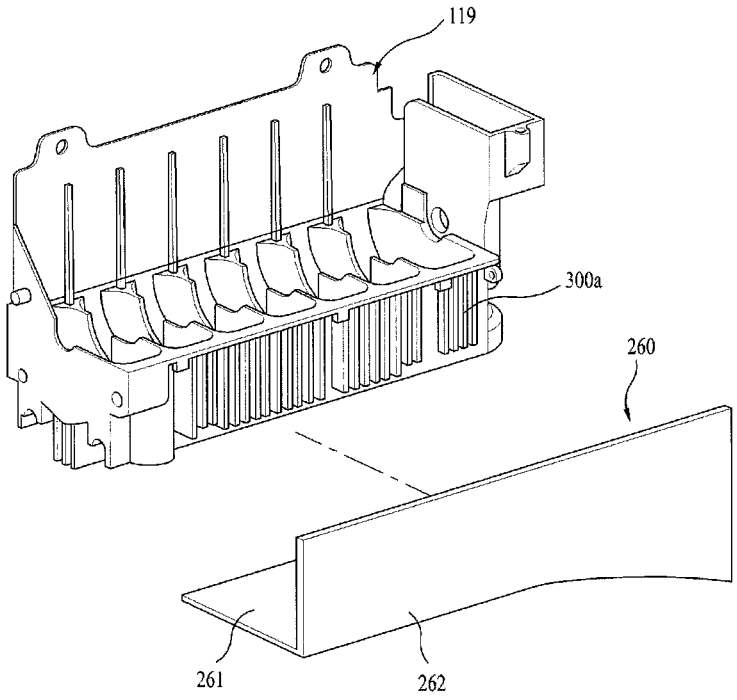
FIG. 15 is a perspective view illustrating an ice making tray and a cold air guide.

As shown in FIG. 15, the cold air guide 260 includes a bottom wall 261 arranged to be spaced apart from the bottom of the ice making tray 119, and a side wall 262 extending upwardly from one side of the bottom wall 261 while being spaced apart from one side of the ice making tray 119.

The bottom wall 261 may have, at one end portion thereof, a curved portion to guide cold air passing through the cold air inlet 251.

Of course, such a curved portion is used when the cold air inlet 251 is arranged at a lower position than the ice making tray 119. Where there is no position level difference between the cold air inlet 251 and the ice making tray 119, the curved portion may or may not be provided.

The cooling fins 300 are arranged in a region defined by the outer surface of the ice making tray 119 and the inner surfaces of the bottom wall 261 and side wall 262 of the cold air guide 260.

The other end of the bottom wall 261 is mounted to an inner surface of one side wall of the ice making compartment 15. Accordingly, the bottom of the ice making tray 119 is surrounded by the inner wall of the ice making compartment 15, and the bottom wall 261 and side wall 262 of the cold air guide 260. In a space surrounding the bottom of the ice making tray 119 in the above-described manner, cold air is present.

Meanwhile, the cooling fins 300 provided at one side surface of the ice making tray 119 extend vertically.

Figure 16:
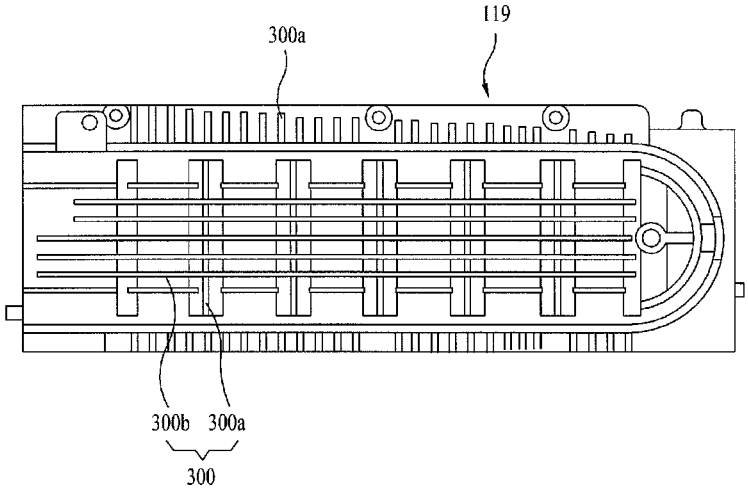
FIG. 16 is a bottom view illustrating the ice making tray and cooling fins.

As shown in FIG. 16, the cooling fins 300 provided at the bottom of the ice making tray 119 includes first cooling fins 300*a* extending in a width direction of the ice making tray 119, and second cooling fins 300*b* extending in a length direction of the ice making tray 119 while intersecting the first cooling fins 300*a*.

In accordance with this configuration, it is possible to increase the area of the ice making tray 119 contacting cold air, and thus to rapidly achieve ice making.

Hereinafter, operation of the refrigerator, in which the cold air guide is arranged beneath the ice making tray, is described.

After water is completely supplied to the ice making tray 119, cold air is introduced through the cold air inlet 251. The cold air passing through the cold air inlet 251 flows toward the bottom of the ice making tray 119 as it is guided by the cold air guide 260.

If the cold air guide 260 is not present, cold air passing through the cold air inlet 251 may immediately fall toward the bottom of the ice making tray 119. The cold air guide 260 may reduce (e.g., prevent) the cold air from immediately falling toward the bottom of the ice making tray 119.

The cold air guided by the cold air guide 260 comes into contact with the outer surface of the ice making tray 119, and the cooling fins 300 provided at the outer surface of the ice making tray 119. Accordingly, the water contained in the ice making tray 19 can be rapidly frozen.

As apparent from the above description, in some implementations, there is an advantage in that it is possible to more rapidly achieve ice making because cold air introduced into the ice making compartment is guided to flow directly toward the ice making device.

In some examples, since the cold air guided to the ice making device is uniformly distributed over the entirety of the ice making tray, there is another advantage in that uniform ice making is achieved.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a door mounted to a body having a refrigerating compartment, the door being configured to open and close at least a portion of the refrigerating compartment;

an ice making compartment provided at the door;

an ice making device arranged in the ice making compartment;

an ice making tray provided at the ice making device and configured to receive and retain liquid to be frozen into ice;

a cold air inlet provided at the ice making compartment and configured to allow cold air to be introduced into the ice making compartment;

a cold air outlet provided at the ice making compartment and configured to allow cold air to discharge from the ice making compartment;

a cold air guide configured to guide cold air entering the ice making compartment through the cold air inlet toward the ice making tray;

a first cold air guide duct positioned to connect to the cold air inlet and introduce cold air through the cold air inlet to the ice making compartment; and a second cold air guide duct positioned to connect to the cold air outlet and receive cold air discharged from the ice making compartment through the cold air outlet, wherein the cold air inlet is positioned higher than the ice making tray and the cold air outlet is positioned lower than the ice making tray, wherein, when the door closes the refrigerating compartment, the first and second cold air guide ducts are respectively connected to the cold air inlet and the cold air outlet, wherein, when the door opens the refrigerating compartment, the first and second cold air guide ducts are respectively disconnected from the cold air inlet and the cold air outlet, wherein the cold air guide extends from the cold air inlet of the ice compartment to a position above the ice making tray and downwardly guides cold air to an upper portion of the ice making tray, wherein the cold air guide has an uppermost wall that defines an uppermost portion of the cold air guide, a lowermost wall that defines a lowermost portion of the cold air guide, side wall that define sides of the cold air guide, and a discharge hole that is defined by the uppermost wall, the lowermost wall, and the side walls, the uppermost wall, the lowermost wall, and the side walls defining a space through which air passes through the cold air guide from an inlet of the cold air guide to the discharge hole of the cold air guide, wherein higher portions of the side walls extend longer than lower portions of the side walls and the discharge hole has an inclined surface protruding from a perimeter of the discharge hole to the lowermost wall that causes uniform supply of cool air throughout the upper portion of the ice making tray.

2. The refrigerator according to claim 1, wherein:

the cold air inlet is arranged at a side wall of the ice making compartment; and the cold air guide is mounted to an inner surface of the side wall of the ice making compartment while being arranged over the ice making tray.

3. The refrigerator according to claim 2, wherein the cold air guide comprises:

a hollow guide body;

an inlet section provided at the guide body such that the inlet section communicates with the cold air inlet; and an outlet section provided at the guide body and configured to discharge cold air toward the ice making tray.

4. The refrigerator according to claim 3, wherein the cold air guide further comprises a guide rib arranged in the guide body and configured to guide cold air flowing from the inlet section toward the outlet section.

5. The refrigerator according to claim 4, wherein the guide rib is inclined with respect to a surface of the ice making tray and configured to change a flow direction of a portion of cold air flowing from the inlet section toward the outlet section.

6. The refrigerator according to claim 4, wherein the guide rib comprises:

an upper guide rib provided at an inner surface of a top of the guide body; and a lower guide rib provided at an inner surface of a bottom of the guide body.

7. The refrigerator according to claim 6, wherein the upper guide rib is arranged in a zone where cold air flowing in the guide body has a maximum flow velocity, and has an inclined portion having a predetermined inclination angle to guide cold air flow through the cold air guide.

8. The refrigerator according to claim 6, wherein the upper guide rib comprises a plurality of upper guide ribs arranged at the inner surface of the top of the guide body while being spaced apart from one another by a predetermined spacing.

9. The refrigerator according to claim 6, wherein the lower guide rib comprises a plurality of lower guide ribs arranged at the outlet section while being inclined with respect to a surface of the ice making tray at different inclination angles.

10. The refrigerator according to claim 6, wherein the lower guide rib is configured to redirect cold air flow to a direction opposite to a flow direction of cold air flowing from the inlet section toward the outlet section.

11. The refrigerator according to claim 1, wherein:

the cold air inlet is arranged at a top wall of the ice making compartment; and the cold air guide is mounted to an inner surface of the top wall of the ice making compartment.

12. The refrigerator according to claim 11, wherein the cold air guide is arranged to extend over an entire top surface of the ice making tray and configured to uniformly distribute cold air passing through the cold air inlet to the entire top surface of the ice making tray.

13. The refrigerator according to claim 11, wherein the cold air guide comprises:

a hollow guide body;

an inlet section provided at a top of the guide body such that the inlet section communicates with the cold air inlet; and an outlet section provided at a bottom of the guide body such that the outlet section directs cold air toward the ice making tray.

14. The refrigerator according to claim 13, wherein the cold air guide further comprises a guide rib arranged in the guide body and configured to uniformly distribute cold air flowing from the inlet section toward the outlet section over the entire top surface of the ice making tray.

15. The refrigerator according to claim 14, wherein the guide rib comprises a plurality of guide ribs arranged at the outlet section while being inclined toward a top surface of the ice making tray at different inclination angles.

16. The refrigerator according to claim 3, wherein the guide body has an extension extending downwardly from a side wall of the guide body, the extension being configured to reduce lateral leakage of cold air from the guide body after entering through the cold air inlet.

17. The refrigerator according to claim 3, wherein the cold air guide further comprises a seal member interposed between the inlet section and the cold air inlet.

18. The refrigerator according to claim 3, wherein the inlet section extends toward the cold air inlet such that an extension of the inlet section is arranged in the cold air inlet.

19. The refrigerator according to claim 1:

wherein the cold air guide comprises an upper guide rib that has an inclined surface and that protrudes, at a central portion of the cold air guide, from the uppermost wall into the space through which air passes through the cold air guide, the upper guide rib having an inclination angle relative to the uppermost wall of about forty-five degrees, wherein the cold air guide comprises a first lower guide rib that protrudes from the lowermost wall into the space through which air passes through the cold air guide and that has a first inclination angle relative to the lowermost wall, a second lower guide rib that protrudes from the lowermost wall into the space through which air passes through the cold air guide and that has a second inclination angle relative to the lowermost wall, and a third lower guide rib that protrudes from the lowermost wall into the space through which air passes through the cold air guide and that has a third inclination angle relative to the lowermost wall, the first inclination angle being smaller than the second inclination angle and the third inclination angle and the second inclination angle being larger than the third inclination angle, and wherein the third lower guide rib is located closer to the inlet of the cold air guide than the upper guide rib, the second lower guide rib, and the first lower guide rib, the upper guide rib is located closer to the inlet of the cold air guide than the second lower guide rib and the first lower guide rib, and the second lower guide rib is located closer to the inlet of the cold air guide than the first lower guide rib.

20. The refrigerator according to claim 19, wherein the cold air guide includes a downward extension that is defined at an end of the cold air guide near the inlet of the cold air guide and that reduces lateral leakage of cold air that has just passed through the inlet of the cold air guide, wherein the outlet of the cold air guide is arranged at a higher position than the inlet of the cold air guide, wherein the downward extension defines a portion of the space through which air passes through the cold air guide, and wherein the downward extension upwardly guides cold air toward the outlet of the cold air guide.

* * * * *